428-911 SR
1/15/80 XR 4,183,097

United States Patent [19]
Mellian

[11] 4,183,097
[45] Jan. 15, 1980

[54] BODY ARMOR FOR WOMEN

[75] Inventor: Sirvart A. Mellian, Watertown, Mass.

[73] Assignee: The United States of America as represented by the Secretary of the Army, Washington, D.C.

[21] Appl. No.: 932,729

[22] Filed: Aug. 10, 1978

[51] Int. Cl.[2] ..... F41H 1/02
[52] U.S. Cl. ..... 2/2.5; 428/911
[58] Field of Search ..... 2/2.5; 428/911

[56] References Cited

U.S. PATENT DOCUMENTS

| | | | |
|---|---|---|---|
| 3,377,974 | 4/1968 | Jaskowski | 2/2.5 X |
| 3,971,072 | 7/1976 | Armellino | 2/2.5 |
| 4,079,464 | 3/1978 | Roggin | 2/2.5 |

*Primary Examiner*—Louis Rimrodt
*Attorney, Agent, or Firm*—Nathan Edelberg; Robert P. Gibson; Lawrence E. Labadini

[57] ABSTRACT

A contoured, all-fabric, lightweight, body armor garment for the protection of the torso of a woman against small arms missiles and spall comprises a contoured front protective armor panel composed of a plurality of superposed layers of ballistically protective plies of fabric made of aramid polymer yarns, the front protective armor panel being contoured by providing overlapping seams joining two side sections to a central section of the panel so as to cause the front protective armor panel to be contoured to the curvature of the bust of a female wearer of the body armor garment to impart good ballistic protection and comfort to the wearer.

6 Claims, 8 Drawing Figures

BODY ARMOR FOR WOMEN

The invention described herein may be manufactured, used, and licensed by or for the Government for governmental purposes without the payment to me of any royalty thereon.

BACKGROUND OF THE INVENTION

This invention relates to all-fabric, body armor for use in protecting the torsos of women, particularly women engaged in law enforcement or military activities.

All-fabric, body armor for protecting the torsos of human beings requires the use of heavy fabric woven from yarn havin high ballistic resistance and, therefore, usually high tenacity, high impact resistance, and other desirable properties contributing to ballistic resistance. Such body armor, if made sufficiently thick to stop small arms missiles at close ranges, is invariably quite stiff and, therefore, difficult to fabricate into body armor garments which can be worn with reasonable comfort while still providing good ballistic protection. This is especially true for body armor for women since the stiff material of the all-fabric, body armor, such as that made from aramid polymer yarns, does not readily conform to the curvature of the body and, therefore, is difficult to use for making satisfactory body armor for women. The usual expedients of cutting fabric sections and seaming them together has not resulted in producing torso protecting body armor having good ballistic protection properties as well as being comfortable to wear for long periods of time because seams of ordinary or customary nature employed in the making of clothing are easily penetrated by small arms missiles at close ranges. Butted seams are particularly vulnerable. But even overlapping seams having conventional amounts of overlapping permit small arms missiles that impact directly at the seam edges to penetrate through the body armor by getting under the edges of the overlapping seam and following a path more or less parallel to the overlapped and seamed portions of fabric.

It is, therefore, an object of the invention to provide an all-fabric, lightweight, body armor garment for the protection of the torso of a woman against small arms missiles and spall which is contoured so as to be reasonably comfortable while providing good ballistic resistance.

A further object of the invention is to provide a method for making an all-fabric, lightweight, body armor garment for the protection of the torso of a woman against small arms missiles and spall and having the abovedescribed properties and advantages.

Other objects and advantages will become apparent from the following description of the invention.

SUMMARY OF THE INVENTION

A contoured, all-fabric, lightweight, body armor garment for the protection of the torso of a woman against small arms missiles and spall comprising a contoured front protective armor panel composed of a plurality of superposed layers of ballistically protective plies of woven fabric made of aramid polymer yarns, the front protective armor panel comprising a center section and two relatively narrower side sections, the side sections being joined to the center section along the respective sides thereof by means of overlapping seams in which the side sections and the center section overlap at least one inch at the seams, both overlapping seams having the plies thereof stitched together approximately midway of the overlapping seams; and a fabric outer garment comprising a front section and a back section, each such section being formed of two layers of fabric joined together along both sides and along the top edges and being openable and closable along their bottom edges by means of a hook and pile type closure so that the contoured front protective armor panel is encased within the front section of the outer garment and, if desired, a back protective armor panel is encased within the back section of the outer garment, the two sections of the outer garment being provided with cooperating hook and pile fasteners attached to elasticized fabric tapes at spaced apart levels along each side of the outer garment and cooperating hook and pile fasteners attached to the top edges of the front and back sections so as to be supported by the shoulders of the wearer and so that the outer garment may be readily adjusted in both circumference and length so as to fit women of varying bust and torso dimensions in such manner as to provide reasonable comfort while providing good ballistic protection of the torso against small arms missiles and shrapnel.

DESCRIPTION OF THE PREFERRED EMBODIMENT

Figure 5:
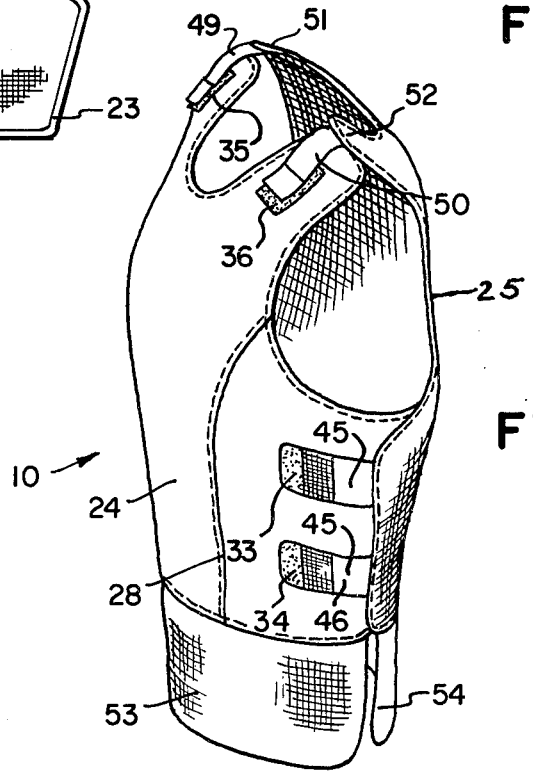
FIG. 5 is a perspective view of a complete body armor garment for a woman, including a front protective armor panel encased in the front section of an outer garment and a back protective armor panel encased in the back section of an outer garment.
Figure 6:
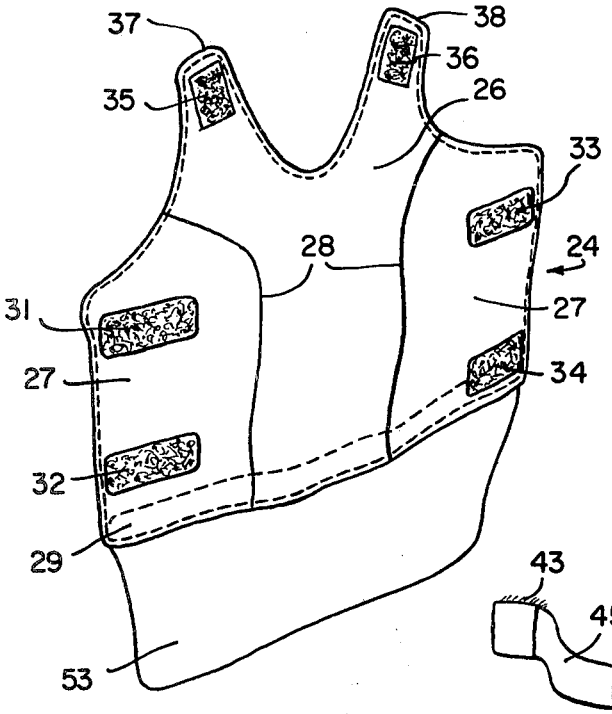
FIG. 6 is a perspective view of the front section of the outer garment as viewed from the outside.
Figure 7:
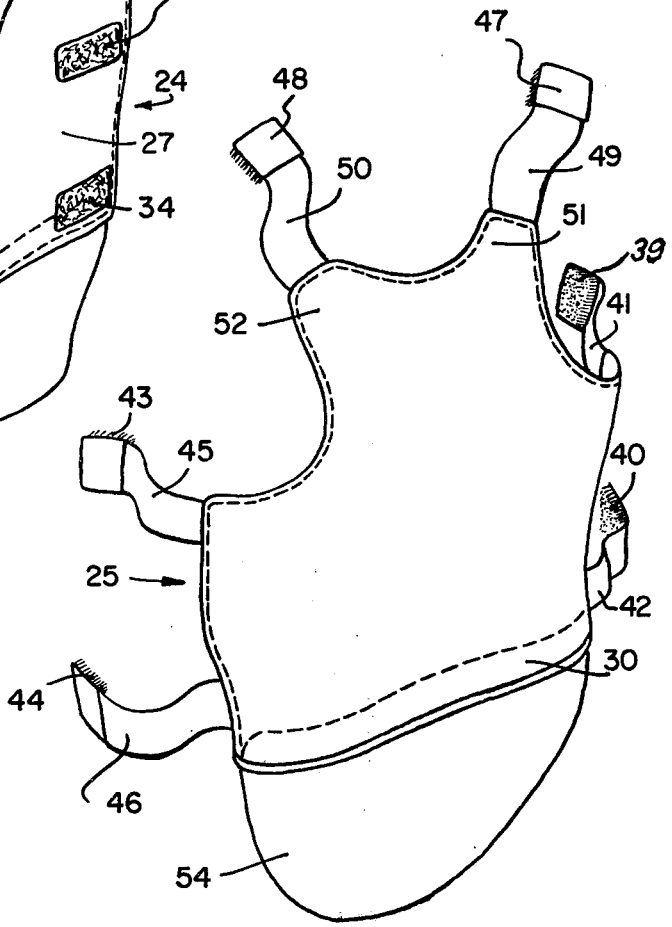
FIG. 7 is a perspective view of the back section of the outer garment as viewed from the outside.
Figure 8:
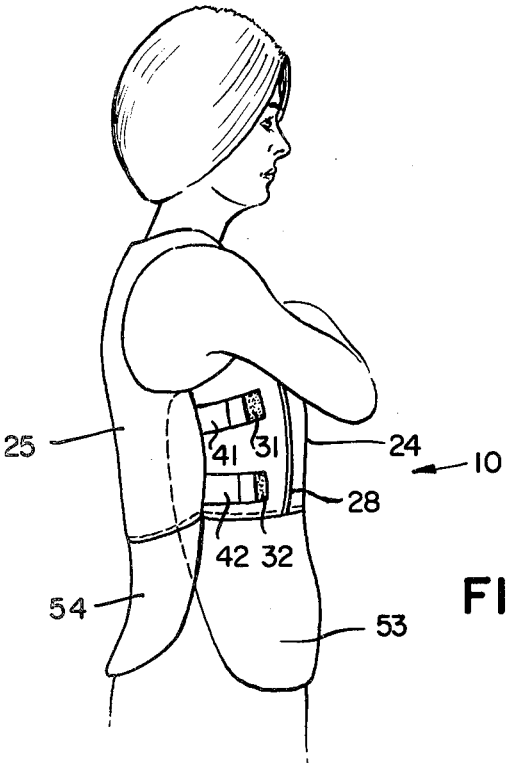
FIG. 8 is a perspective view of the complete body armor garment of the invention being worn by a woman.

Reference numeral 10 indicates a complete protective body armor garment in accordance with the invention, particularly for a woman, as shown in FIG. 5 and FIG. 8.

Figure 1:
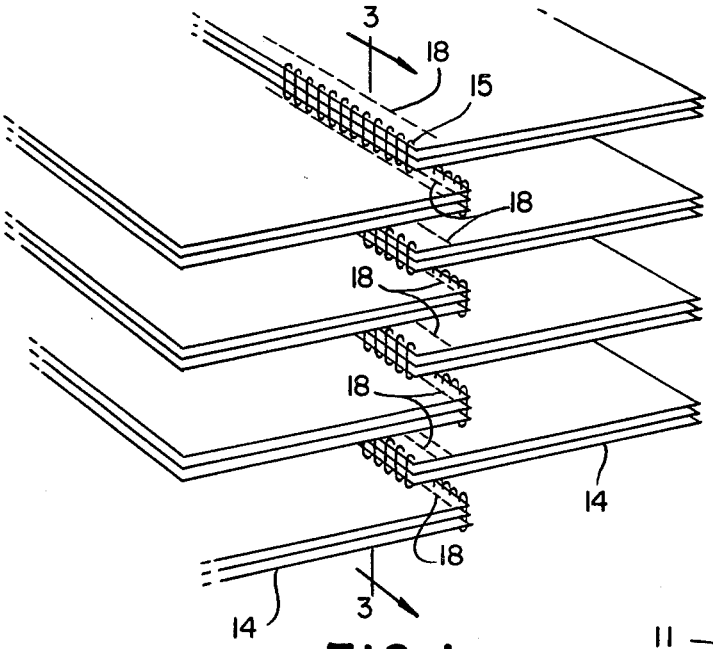
FIG. 1 is an exploded perspective view of a 12-ply ballistic armor fabric construction in accordance with the invention, the armor fabric having overlapping seams joining eight layers of fabric, each layer consisting of three plies of ballistic fabric and being overedge stitched to prevent ravelling of the yarns of the ballistic fabric.
Figure 3:
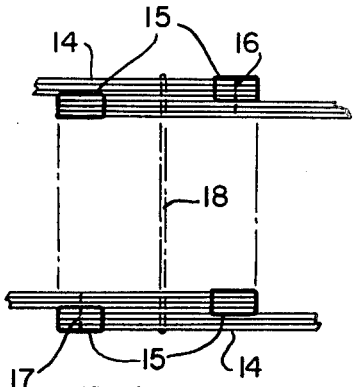
FIG. 3 is a vertical section through the overlapping seams and perpendicular thereto along a plane through the line 3—3 of FIG. 1.
Figure 2:
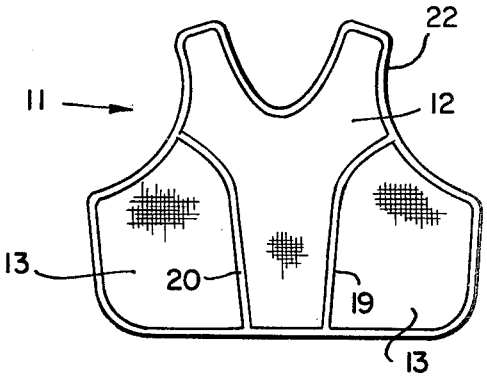
FIG. 2 is a plan view of the front body armor panel for a body armor garment designed to be worn by a woman and showing the overlapping seams which cause the front body armor panel to be contoured with respect to the torso of a female wearer of the body armor.
Figure 4:
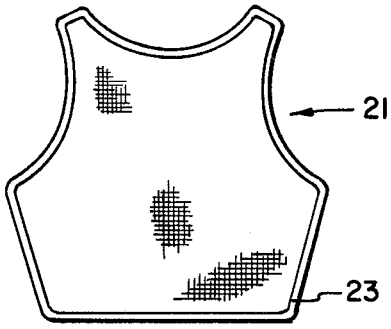
FIG. 4 is a plan view of the back body armor panel for a body armor garment to complement the front body armor panel of FIG. 2.

Reference numeral 11 indicates a front protective armor panel constructed of a center section 12 and two side sections 13, each made of a plurality of superposed plies 14 of ballistic resistant fabrics, as shown in FIGS. 1 and 3. In the front protective armor panel of FIGS.

1–3 the multiple plies of ballistic resistant fabric are joined together in groups of three plies to form layers by overedge stitching three plies together along an edge, the overedge stitching being indicated by reference numeral 15 and being from about 3/16 to about ⅜ inch wide, and usually being about ¼ inch wide. Two separate layers of three plies cut with the help of patterns, one layer from the center section 12 and the other from the side section 13, to the outline shape of the center section and of one of the side sections, are overlapped at least one inch, as shown in FIG. 3, and stitched together, for the two uppermost layers. This stitching of the two uppermost layers together is represented by reference numeral 16, passing substantially midway of the overedge stitching of the uppermost layer downwardly through the three plies of the uppermost layer and the three plies of the next lower layer. Similarly, two layers of three plies each, cut with the help of patterns to the outline shape of the center section and of one of the side sections, are overlapped at least one inch, as shown in FIG. 3 and stitched together, for the two lowermost layers. This stitching of the two lowermost layers together is represented by reference numeral 17, passing substantially midway of the overedge stitching of the lowermost layer upwardly through the three plies of the lowermost layer and the three plies of the next higher layer. Depending on the total number of layers and plies of ballistic resistant fabric desired in the front panel, additional layers of three plies each may be cut with the help of patterns as in the case of the two uppermost layers, overedge stitched, and overlapped at least one inch and stitched together. These stitched together pairs of layers are then placed between the uppermost combination of layers and the lowermost combination of layers; and the whole assembly is stitched together, this stitching being represented by reference numeral 18 which passes through the several overlapped seams about midway from side to side of the overlapped material. Thus, overlapped seams, represented by reference numerals 19 and 20 are formed where the center section joins the two side sections of the front armor panel. The overlapping seams are located in the front armor panel so as to make possible contouring of the front armor panel to conform to the curvature of the female body in the bust area.

It is to be understood that instead of three plies, each layer may contain from two to five plies of ballistic fabric.

The armor panel fabric is woven from about b 1000 denier aramid yarn.

Reference numeral 21 designates the back armor panel which is made of a plurality of plies (two to five plies) of ballistically resistant fabric, all of the plies being stitched around the periphery of the back armor panel. Thus, the back armor panel is very stiff because of the number of plies usually required to provide adequate ballistic protection and the lack of seams which permit contouring, as in the above-described front armor panel.

Both the front and back armor panels are provided with piping 22 and 23 stitched to the peripheral edges of the front and back armor panels, respectively, to assist in preventing ravelling of the plies of ballistically resistant fabric at the peripheral edges of the armor panels.

The front and back armor panels must be supported on the body to provide protection of the torso against missiles. If desired, the front armor panel only may be worn, thus limiting protection to that against missile fire directed toward the front of the wearer of the body armor. Usually, however, it is desirable to protect the torso both from the front and back; hence both the front armor panel 11 and the back armor panel 21 are supported on the body of the wearer so as to obtain maximum protection against small arms missiles fired at relatively close ranges. This is accomplished by providing a fabric outer garment comprising two sections, a front section 24 and a back section 25. The front section 24 comprises two layers of fabric stitched together along both sides and along the top edge. The front or outside layer is made of a center section 26 and two somewhat narrower side sections 27 which are stitched to the center section 26 along seams 28. The front section is also provided with a hook and pile type closure 29 at the bottom thereof which is easily openable to permit insertion of the front armor panel into the front section of the outer garment and closable by means of the hook and pile elements of the hook and pile closure 29. The back section 25 comprises two layers of fabric stitched together along both sides and along the top edge and is provided with a hook and pile type closure 30 at the bottom thereof which is easily openable to permit insertion of the back armor panel into the back section of the outer garment and closable by means of the hook and pile elements of the hook and pile closure 30.

The front section 24 of the outer garment is provided with pile type fastener elements 31 and 32 attached to the outside surface of one side section thereof at spaced apart points and pile type fastener elements 33 and 34 attached to the outside surface of the other side section thereof at spaced apart points, and pile type fastener elements 35 and 36 attached to the shoulder extensions 37 and 38, respectively, of the front section of the outer garment. The back section 25 of the outer garment is provided with hook type fastener elements 39 and 40 attached to the outside surface of the back section at spaced apart points along one side thereof by means of elastic tabs 41 and 42, respectively, these hook type fastener elements cooperating with pile type fastener elements 31 and 32 on the front section in an adjustable relationship. The back section 25 of the outer garment is also provided with hook type fastener elements 43 and 44 attached to the outside surface of the back section at spaced apart points along the other side thereof by means of elastic tabs 45 and 46, respectively, these hook type fastener elements cooperating with pile type fastener elements 33 and 34 on the front section in an adjustable relationship. The adjustability of the hook and pile type fasteners spaced apart along both sides of the front and back sections of the outside garment make possible adjustment of the girth of the complete body armor with respect to the girth of the wearer thereof.

The back section 25 of the outer garment is provided with hook type fastener elements 47 and 48 attached by elastic tabs 49 and 50, respectively, to shoulder extensions 51 and 52, respectively, of the back section of the outer garment, these hook type fastener elements cooperating with pile type fastener elements 35 and 36 on the front section in an adjustable relationship. The adjustability of the hook and pile type fasteners attached to the shoulder extensions make possible adjustment of the length of the outer garment and, therefore, of the complete body armor. Thus the body armor has excellent adjustability to a wide range of bust and torso lengths.

The front section of the outer garment is also provided with a skirt 53 and the back section is provided with a skirt 54, both of which skirts extend below the torso of the wearer and serve to help to stabilize the complete body armor in place on the body of the wearer, especially when the skirts are tucked beneath and held in place by a belt or waistband of an outer skirt or dress or a pair of slacks.

When the contoured, all-fabric, body armor garment of the invention is worn by a woman who is exposed to small arms gunfire, the wearer is well protected throughout all of the torso region of her body by a body armor garment which weighs only about two pounds.

The contoured, all-fabric, lightweight body armor garment of the invention has been found to be effective in protecting the torsos of women against small arms missiles and spall while being reasonably comfortable to wear over a period of several hours. The overlapping seams of the front protective armor panel, with overlappings of at least one inch, have made possible the resistance to penetration of the front protective armor panel at the seams regardless of how close to the seam the missile or fragment of spall impacts, its angle of impact, or other characteristics of the impact, at least equal to that of the unseamed portions of the front protective armor panel; whereas, prior to the invention, when butted seams were used or overlapped seams of less than one inch overlap were used, the seams constituted a line of weakness and vulnerability to penetration greater than that of portions of the front protective armor panel spaced from the seams. The overlapping seams make the body armor garment not only more comfortable to wear but also make it difficult for anyone to detect whether a woman is wearing body armor. They also effect better underarm protection against missiles since the body armor garment fits better in that area than armor made without such overlapping seams.

It will be understood that various changes in the details, materials and arrangements of parts which have been herein described and illustrated in order to explain the nature of the invention, may be made by those skilled in the art within the principle and scope of the invention.

I claim:

1. A contoured, all-fabric, body armor garment for the protection of the torso of a woman against small arms missiles and spall which comprises:

a. a contoured front protective armor panel composed of a plurality of superposed layers of ballistically protective plies, each layer comprising from two to five plies of woven fabric made of aramid polymer yarns, said aramid polymer yarns having a denier of about 1000, said front protective armor panel comprising a center section and two side sections each relatively narrower than said center section, one of said side sections being joined to said center section along one side thereof by means of an overlapping seam in which said one side section overlaps said center section at least one inch, the other of said side sections being joined to said center section along the other side thereof by means of an overlapping seam in which said other side section overlaps said center section at least one inch, both of said overlapping seams having the plies thereof stitched together approximately midway from side to side thereof; and b. means for supporting said front protective armor panel on the torso of a woman wearer thereof.

2. A body armor garment according to claim 1, wherein said means for supporting said front protective armor panel on the torso of a woman wearer thereof is a fabric outer garment comprising two sections, each of the two sections containing two layers of fabric stitched together along both sides and along the top edges thereof while being openable and closable along the bottom edge thereof by means of a hook and pile type closure so that said contoured front protective armor panel is encased within the front section of said outer garment and is easily removed therefrom when said outer garment or said contoured, all-fabric, body armor garment requires cleaning, and the back section is openable and closable along the bottom edge thereof by means of a hook and pile type closure, said two sections of said outer garment being provided with cooperating hook and pile fasteners attached to fabric tapes at at least two spaced apart levels along each side of said outer garment so that said outer garment is easily adjustable in circumference, and cooperating hook and pile fasteners attached to fabric tapes at the top edges of said front and rear sections so that said outer garment is thereby made easily adjustable in length, whereby said outer garment is easily and quickly adjusted to fit various sized female busts and torsos.

3. A body armor garment according to claim 2, wherein said garment also comprises a back protective armor panel composed of a plurality of superposed plies of woven fabric made of aramid polymer yarns, said aramid polymer yarns having a denier of about 1000, said back protective armor panel being substantially flat, each ply thereof being cut from a single flat piece of fabric, said plurality of plies being stitched together around their peripheries, said back protective armor panel being encased within said back section of said fabric outer garment and being easily removed from said back section of said fabric outer garment when said fabric outer garment or said contoured, all-fabric, body armor garment requires cleaning.

4. A body armor garment according to claim 3, wherein both said contoured front protective armor panel and said back protective armor panel comprise at least seven plies of said fabric woven from said aramid polymer yarns.

5. A body armor garment according to claim 2, wherein said contoured front protective armor panel comprises at least seven plies of said fabric woven from said aramid polymer yarns.

6. A body armor garment according to claim 1, wherein said contoured front protective armor panel comprises at least seven plies of said fabric woven from said aramid polymer yarns.

* * * * *